US005139268A

United States Patent [19]

Garnett

[11] Patent Number: 5,139,268

[45] Date of Patent: Aug. 18, 1992

[54] DRUG USE DETERRING GAME

[76] Inventor: Howard Garnett, 2334 W. 77th Ave., Philadelphia, Pa. 19150

[21] Appl. No.: 704,172

[22] Filed: May 22, 1991

[51] Int. Cl.[5] ..... A63F 3/00

[52] U.S. Cl. ..... 273/249

[58] Field of Search ..... 273/242, 243, 248, 249, 273/256

[56] References Cited

U.S. PATENT DOCUMENTS

| | | | |
|---|---|---|---|
| 1,095,934 | 5/1914 | Seed | 273/249 |
| 1,391,333 | 9/1921 | McManus | 273/249 |
| 2,026,082 | 12/1935 | Darrow | 273/256 |
| 2,717,157 | 9/1955 | Dylewski | 273/243 |
| 4,065,131 | 12/1977 | Martin, Jr. et al. | 273/243 |
| 4,216,971 | 8/1980 | Lyke | 273/243 |
| 4,279,422 | 7/1981 | Shaw | 273/243 X |
| 4,884,818 | 12/1989 | Fogarty | 273/269 X |
| 4,962,934 | 10/1990 | Taylor | 273/249 |

*Primary Examiner*—Paul E. Shapiro
*Assistant Examiner*—William E. Stoll
*Attorney, Agent, or Firm*—H. Jay Spiegel

[57] ABSTRACT

A board game is disclosed which is intended to teach children to lead honest, law abiding lives, and to stay away from drugs. The inventive board has two concentric paths, an outer longer path and an inner shorter path. Players who choose to attempt to take the shorter path face pitfalls which can slow their progress, while players who choose the longer path are assisted in their travels when landing on "say no and go" spaces. In the center of the board, a drug free zone is provided and the object of the game is for a player to end up with all of their game tokens in the drug free zone after each token has completely circled the board once.

8 Claims, 3 Drawing Sheets

DRUG USE DETERRING GAME

BACKGROUND OF THE INVENTION

Board games are known in the prior art. U.S. Pat. No. 3,643,958 to Sperber and U.S. Pat. No. 4,012,045 to Vail disclose games wherein various aspects of life in society are included. However, neither of these board games teaches the main aspects of the present invention.

In society, today, drug use persists and it has become increasingly difficult to teach children to avoid drug use when they see drug dealers driving fancy cars, wearing jewelry and elegant clothing and seeming to have great wealth and success.

Children sometimes do not understand the addictive nature of drugs and don't realize how important it is to avoid even experimenting with drugs. As such, a need has developed for a means for teaching children the pitfalls of drug use as well as the benefits of avoiding drug use, working hard, doing well in school and generally contributing to society.

It is in the spirit of these aspects of life that the present inventive game was developed.

SUMMARY OF THE INVENTION

The present invention relates to a game known as the "SAY NO AND GO" game. The inventive game includes the following interrelated objects, aspects and features:

A) In a first aspect, the inventive game is played on a board having a particular design thereon. The board is generally square in configuration having two closed paths on which player tokens may travel.

B) A first closed path is an outer path which is the longer of the two paths. In the outer path, there are 44 spaces which must be traveled in making one revolution. In the outer path, there are 12 spaces having a logo and the words "say no and go". When such a space is landed upon, a player must pick a "say no and go" card which will give instructions as to how to proceed. Generally speaking, say no and go"cards are encouraging and reward the player for hard work, good study habits, legal behavior, etc.

C) The inner closed path has 28 spaces. Thus, theoretically, one should be able to make one circuit of the board in fewer turns using the inner path than would be possible using the outer path. However, the inner path has a plurality of "skull and crossbones" spaced, particularly eight such spaces, which when landed upon require the picking of a "skeleton" card. These "skeleton" cards have instructions thereon as to how to proceed and, generally speaking, impede the player's progress. "Skeleton" cards may cause a player's token to go to jail, to lose a turn, to go back one or move spaces, etc.

D) The object of the game is for a player to have all of their tokens travel one revolution around the board and then travel to the drug free zone. Various other rules and regulations will be described in greater detail hereinafter.

As such, it is a first object of the present invention to provide an improved game known as the "SAY NO AND GO" game.

It is a further object of the present invention to provide such a game which educates children about the pitfalls of drug use and encourages children to lead law abiding, trouble free lives.

It is a further object of the present invention to provide such a game played on an aesthetically pleasing board having two concentric closed paths.

It is a further object of the present invention to provide such a board having a central drug free zone where players seek to place their tokens during the playing of the game.

These and other objects, aspects and features of the present invention will be better understood from the following detailed description of the preferred embodiment when read in con]unction with the appended drawing figures.

SPECIFIC DESCRIPTION OF THE PREFERRED EMBODIMENT

Figure 1:
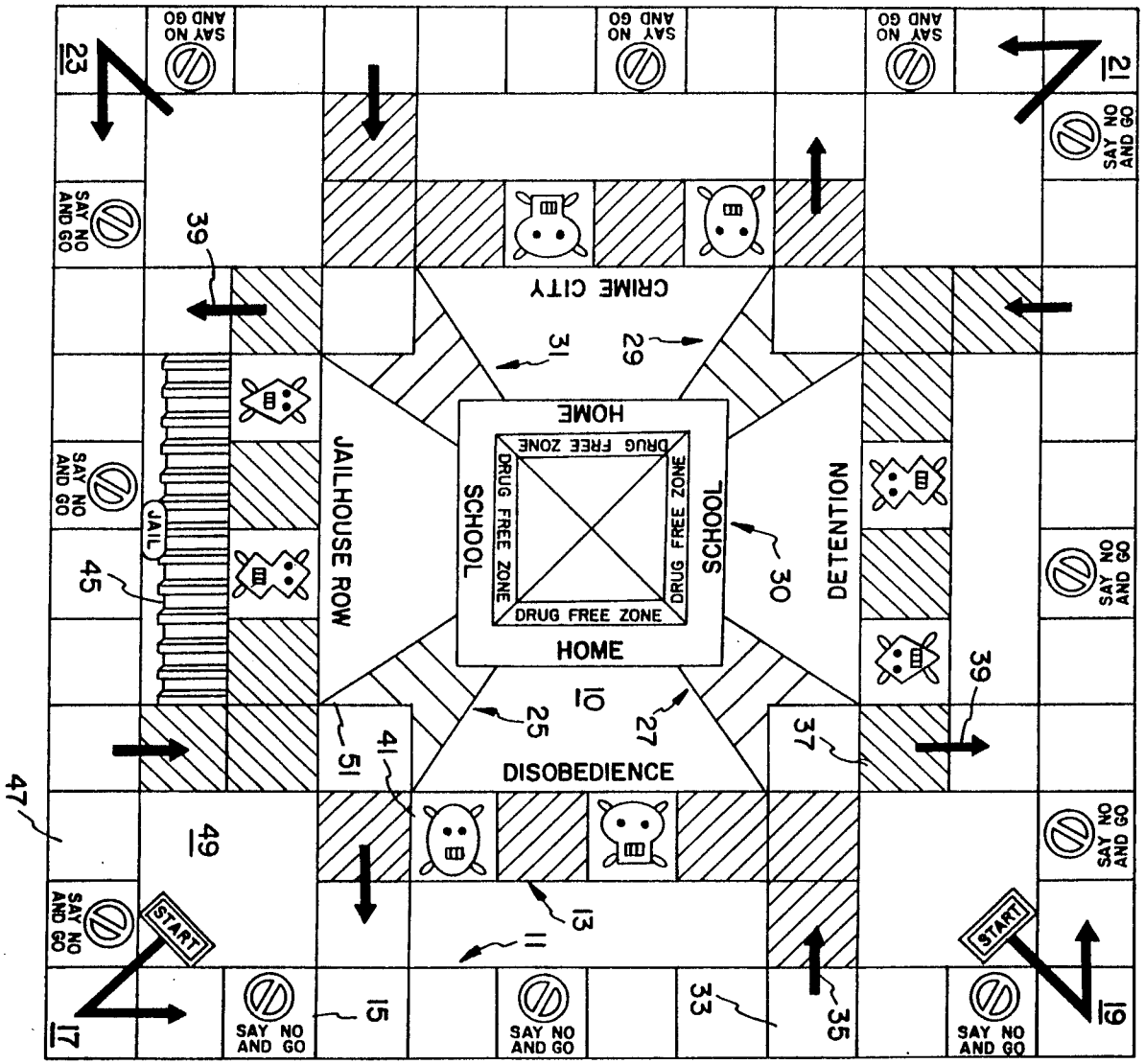
FIG. 1 shows the board which is used to play the inventive game.

With reference, first, to FIG. 1, the inventive board is generally designated by the reference numeral 10 and is seen to include an outer path 11 and an inner path 13. The outer path has 44 squares whereas the inner path has 28 squares.

With reference, first, to the outer path 11, it is seen that this path includes a plurality of squares having a logo with a circle and a line through it and the words "say no and go". These spaces are generally designated by the reference numeral 15 Each corner of the board has a start square with these squares being designated by the reference numerals 17, 19, 21 and 23. Preferably, each start square is in a unique color, for example, pink, blue, orange and yellow and each player chooses a color and a particular start square where all of the players, tokens commence play. Corresponding to each start square is a ramp which each player uses to enter the drug free zone. Thus, there is a pink ramp 25, a blue ramp 27, an orange ramp 29 and a yellow ramp 31. Thus, a player must cause their tokens to make one revolution of the board and then go to the drug free zone 30 using the ramp corresponding to their color.

Figure 4:
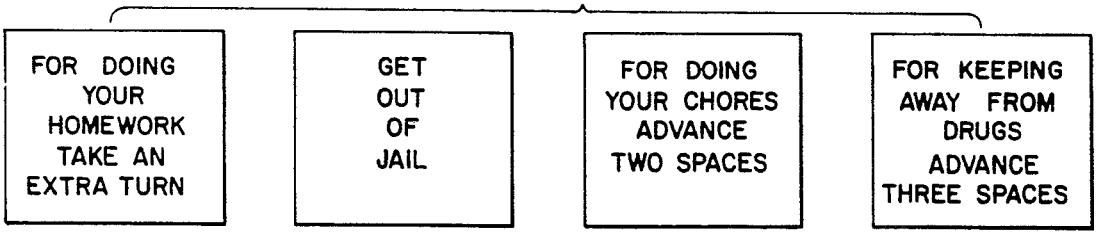
FIG. 4 shows schematic representations of examples of "say no and go" cards which are used in playing the game.

A player traveling on the outer path 11 may land on one of the spaces 15 labeled "say no and go". When this occurs, the player must pick a card from a pile of cards known as the "say no and go" cards, which are illustrated in FIG. 4. Each card has particular instructions which must be followed by the player who lands there. These cards are generally supportive and reward the player for good behavior and the like. These cards reward the player for choosing a drug free life, a life without crime, for passing tests in school, doing homework, doing chores, obeying parents and teachers, being courteous and displaying good manners. The "say no and go" cards allow the player an extra turn, movement for a determined number of additional spaces, and include a wild card allowing a player to get out of ]ail should the player have a token which has gone to ]ail for reasons which will be set forth in greater detail hereinafter.

The outer path 11 also includes four squares 33 which each have an arrow 35 thereon directing the player to make a turn and go toward the inner path 13. When a player has rolled the dice and has ended up on one of these squares 33, the player must follow the arrow toward the inner path 13. However, the player may also make the decision to leave the inner path when arriving at one of the squares 37 having an arrow 39 pointing in the direction of the outer path 11. Thus, a player may only travel from the outer path 11 to the inner path 13 using one of the spaces 33, and may only go from the inner path 13 to the outer path 11 using one of the spaces 37.

The inner path 13 includes, as stated above, 28 spaces. Eight of these spaces, designated by the reference numeral 41 display a "skull and crossbones" design. When a player's turn has ended with their token on a "skull and crossbones" space 41, that player must draw a "skeleton" card and must follow the instructions set forth thereon. "Skeleton" cards have instructions which fall into three general categories.

Firstly, the card may cause the player to place their token in the jail 45 due to drinking and driving, selling drugs, possession of drugs, underage drinking, stealing and shoplifting, etc. When a player has one of their tokens in jail, that player may not advance any of their other tokens until such time as the token has been removed from jail. The token may be removed from jail in one of two ways. Either the player may use a "get out of jail" card which they had drawn when landing on a "say no and go" space 15, or the player may roll "doubles" with the dice.

In the former case, the player must stay on the "skeleton" where they were when they were caused to go to jail and may advance on their next turn, returning the "get out of jail" card to the bottom of the "say no and go" deck of cards.

Alternatively, in the latter case, when "doubles" have been rolled, the player must return their token to the start space, for example, the pink space 17 and must start their revolution around the board with that token all over again.

Going back to the "skeleton" cards, the following offenses which when printed on a "skeleton" card which has been chosen will cause that player to lose a turn: reporting to school late, lying, cheating, failing to complete a homework assignment, skipping class or playing hookey. The following offenses which when printed on a "skeleton" card which has been chosen by a player would cause the player to have to digress one, two or three spaces as printed on the card: disobedience, sleeping in class, not doing what one is told, watching too much television, not studying enough, being rude.

The object of the game is for players to cause their four tokens to travel one revolution about the board and then through successive rolls of the dice, have their tokens travel to the drug free zone on their ramp 25, 27, 29 or 31. Looking at the start space 17, it is seen that two spaces before the start space 17, another space 47 is provided which is of the same color as the start space 17. Furthermore, a large space 49 of the same color is adjacent the space 47 and connects with a yet further space 51 of the same color and at the bottom of the ramp 25. Thus, when a player has started on the space 17 and has traveled around the board in one revolution, on the outer path 11, when that player arrives at the space 47, the token may then travel on the space 49, on the space 51 and then up the ramp 25. If the player had chosen to move their token on the inner path 13, when the space 51 is arrived at, that token may then go up the ramp 25. Corresponding instructions are to be followed concerning the other start spaces 19, 21, 23 and the corresponding colored spaces adjacent thereto.

Figure 2:
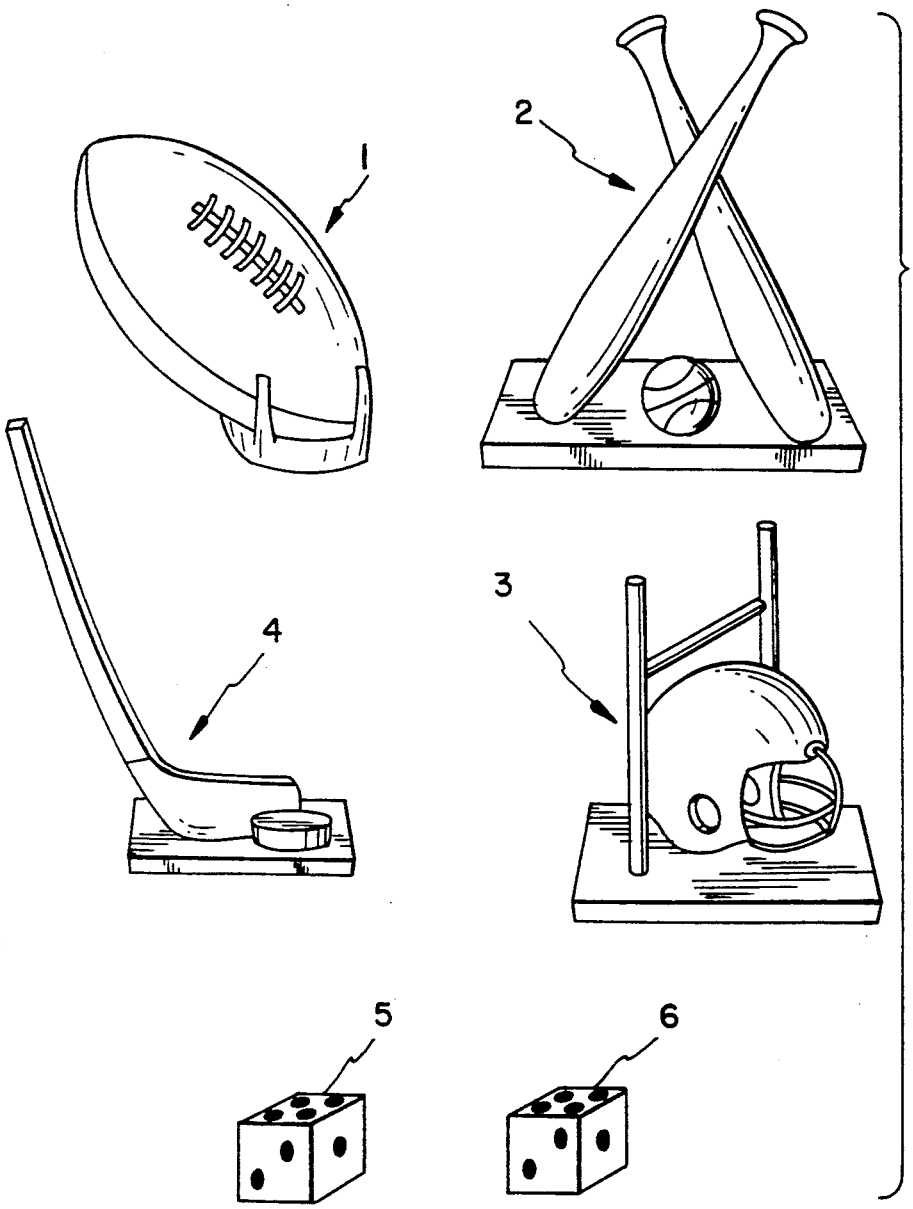
FIG. 2 shows examples of tokens which may be used in the playing of the game as well as the dice which may be used in playing the game.

FIG. 2 shows four examples 1, 2, 3 and 4 of token designs which may be employed in playing the inventive game. Of course, any desired design for the tokens may be employed including, for example, a ballerina, a gymnast or any other desired design. Furthermore, FIG. 2 shows the dice 5 and 6 which are also used in playing the game as described above.

Figure 3:
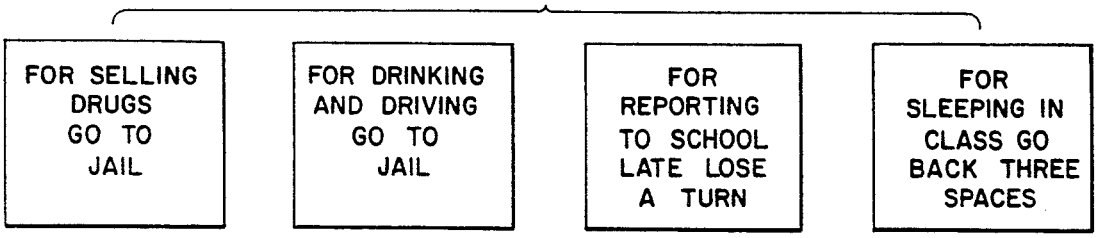
FIG. 3 shows schematic representations of examples of "skeleton" cards which are used in playing the game.

FIG. 3 shows several examples of "skeleton" cards which may be used in playing the inventive game.

FIG. 4 shows several examples of "say no and go" cards.

Having described the game board, tokens and dice in great detail, it is now believed appropriate to generally review the rules of the game.

The game may be played with up to four players. Each player starts with four game tokens such as those illustrated in FIG. 2 and each player starts at one of the four start areas or home bases which are designated by the reference numerals 17, 19, 21 and 23. If desired, the players may consecutively roll the dice to determine who plays first based upon the highest or lowest number rolled.

The game proceeds around the board in a counterclockwise direction, with the first player to get all of their tokens to the center of the board in the drug free zone 30 being declared the winner.

Players may travel on the outer path 11 or the inner path 13 and may transfer from the outer path to the inner path only at the squares 33 and may travel from the inner path to the outer path only at the squares 37.

Should a player land on a "say no and go" square 15, the player must draw a "say no and go" card as illustrated in FIG. 4 and must follow the instructions set forth thereon.

Should a player land on a "skull and crossbones" square 41, that player must pull a "skeleton" card and must follow the instructions set forth thereon. Should those instructions include landing in jail, the player may get out of jail either by using a "get out of jail" card which had been drawn when landing on a "say no and go" square 15 or may get out of jail by rolling "doubles" on the dice.

If a player's token lands on a square where someone else's token is already located, the other player's token must be returned to their start square and must start over again. If, on the other hand, a player lands on a square where their own token is located, both tokens may remain.

When a player's token has traversed the board and has either arrived at a space such as the space 47 in the outer path 11 or a space corresponding thereto adjacent another start area, or has arrived at the space 51 on the inner path or another space corresponding thereto adjacent another start area, that token may then travel up the associated ramp and may be placed in the drug free zone 30. When a player has managed to have all of their tokens travel about the board, up the ramp and into the drug free zone 30, that player is declared the winner.

As such, an invention has been disclosed in terms of a preferred embodiment thereof which fulfills each and every one of the objects of the invention as set forth hereinabove and provides a new and improved game of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved board game, comprising:

a) a board having an outer path and an inner path, said inner path having fewer spaces than said outer path;

b) solely said outer path having a plurality of "say no and go" spaces which, when landed upon, require pickinq of a "say no and go" card and following instructions printed thereon;

c) solely said inner path having a plurality of "skull and crossbones" spaces which, when landed upon, require picking of a "skeleton" card and following instructions printed thereon;

d) said board having a centrally located drug free zone accessible by any one of a plurality of ramps, each of which may be accessed via either path;

e) said board having a jail area;

f) said game being played by a plurality of players each having a plurality of game tokens and using a chance device to determine token movements;

g) each "say no and go" card having a helpful instruction compensating for the longer outer path, each "skeleton" card having a negative consequence compensating for the shorter inner path;

h) the object of the game being for a player's token to traverse the board using the outer path and/or the inner path and to cause all tokens to arrive at the drug free zone.

2. The invention of claim 1, wherein said outer path includes at least one space allowing access to said inner path.

3. The invention of claim 1, wherein said inner path includes at least one space allowing access to said outer path.

4. The invention of claim 1, wherein each player has four tokens.

5. The invention of claim 1, wherein at least one "skeleton" card instructs a player to place one token in the jail area.

6. The invention of claim 5, wherein at least one "say no and go" card allows said one token out of the jail area.

7. The invention of claim 1, wherein said chance device comprises a pair of dice.

8. The invention of claim 1, wherein said board is generally rectangular having four corners with said outer path having a start square in each corner.

* * * * *